US009865184B2

(12) United States Patent
Jungnickel et al.

(10) Patent No.: US 9,865,184 B2
(45) Date of Patent: Jan. 9, 2018

(54) DISPLAY PANEL AND MANUFACTURING A TRANSLUCENT CARRIER ELEMENT OF THE DISPLAY PANEL

(75) Inventors: Uwe Jungnickel, Taunus (DE); Wolfgang Stegmann, Frankfurt am Main (DE)

(73) Assignee: BRAUN GMBH, Kronberg (DE)

( * ) Notice: Subject to any disclaimer, the term of this patent is extended or adjusted under 35 U.S.C. 154(b) by 159 days.

(21) Appl. No.: 12/896,974

(22) Filed: Oct. 4, 2010

(65) Prior Publication Data

US 2011/0247158 A1 Oct. 13, 2011

(51) Int. Cl.

| | |
|---|---|
| ***G09F 13/06*** | (2006.01) |
| ***G09F 13/08*** | (2006.01) |
| ***G09F 23/00*** | (2006.01) |
| *G09F 13/00* | (2006.01) |
| *G09F 13/04* | (2006.01) |
| *G09F 13/14* | (2006.01) |

(52) U.S. Cl.

CPC ..... *G09F 13/06* (2013.01); *G09F 13/08* (2013.01); *G09F 23/0075* (2013.01); *G09F 13/00* (2013.01); *G09F 13/04* (2013.01); *G09F 13/14* (2013.01); *G09F 2013/0481* (2013.01)

(58) Field of Classification Search

CPC ..... G09F 13/06; G09F 13/08; G09F 13/04; G09F 13/00; G09F 13/14; G06F 23/0075

USPC ..... 40/544, 314, 800, 552

See application file for complete search history.

(56) References Cited

U.S. PATENT DOCUMENTS

| | | | | |
|---|---|---|---|---|
| 3,406,475 | A * | 10/1968 | O'Donnell | 40/546 |
| 4,811,507 | A * | 3/1989 | Blanchet | 40/546 |
| 4,891,896 | A * | 1/1990 | Boren | 40/541 |
| 5,345,705 | A * | 9/1994 | Lawrence | 40/616 |
| 5,604,480 | A * | 2/1997 | Lamparter | 362/478 |
| 5,806,957 | A | 9/1998 | Siegel | |
| 5,921,012 | A * | 7/1999 | Caivano | 40/541 |
| 7,721,475 | B2 * | 5/2010 | Chiang et al. | 40/541 |
| 2006/0254702 | A1 | 11/2006 | Emslander et al. | |
| 2007/0186453 | A1 * | 8/2007 | Little et al. | 40/314 |
| 2008/0141476 | A1 * | 6/2008 | Gatzemeyer et al. | 15/105 |

FOREIGN PATENT DOCUMENTS

| | | |
|---|---|---|
| DE | 20200808101 | 10/2008 |
| EP | 0791911 | 8/1997 |
| EP | 1058227 | 12/2000 |
| GB | 840424 | 7/1960 |

OTHER PUBLICATIONS

International Search Report and written opinion, dated Nov. 23, 2010, 9 pages.

* cited by examiner

*Primary Examiner* — Syed A Islam

(57) ABSTRACT

A display panel including a translucent carrier element that has an inner side, an outer side, and a display area is provided. At least one display element is arranged within the display area, the display element being formed by geometric structures realized as protrusions and/or depressions on both of the inner side and the outer side of the translucent carrier element. The display panel can be used in an information display that in particular comprises at least a light emitting element for backlighting the display element. The information display can be used in an appliance such as an electric toothbrush, wherein the protrusions and/or depressions integrally formed with the translucent carrier element.

19 Claims, 6 Drawing Sheets

DISPLAY PANEL AND MANUFACTURING A TRANSLUCENT CARRIER ELEMENT OF THE DISPLAY PANEL

CROSS REFERENCE TO RELATED APPLICATION

This application claims the benefit of European Patent Convention Application No. 09012797.8, filed on Oct. 9, 2009, the substance of which is incorporated herein by reference.

FIELD OF THE INVENTION

The present disclosure relates to a display panel. More particularly, the present disclosure relates to an information display comprising the display panel, an appliance that comprises the information display, and a method of manufacturing a translucent carrier element of the display panel.

BACKGROUND OF THE INVENTION

In electronic and electromechanical handheld appliances, which can be manually handled, light emitting elements are provided in the interior thereof, in particular in the form of LEDs, through which specific switching and operating states of the appliance are visualized to a user. These light emitting elements are typically arranged in the interior of the housing so that corresponding lighted dots can be generated that are usually associated to or with an explanatory print on the outside of the housing (for example, "Charge Status" could be printed onto the housing and the lighted dot could change between a green color and a red color).

A backlit display panel is known from DE 20 2008 008 101, which comprises a light-transparent main body, an outer light-transparent cover layer and an inner light-opaque cover layer being provided on this main body. The inner light-opaque cover layer is locally provided with a pictogram mask. With corresponding backlighting of the main body, the lighted image generated by the pictogram mask is visible through the main body and the outer cover layer.

SUMMARY OF THE INVENTION

In one embodiment, a display panel includes a translucent carrier element that has an inner side, an outer side and a display area; and at least one display element being arranged within the display area. The display element is formed by geometric structures realized as protrusions and/or depressions on both of the inner side and the outer side of the translucent carrier element. The protrusions and/or depressions are integrally formed with the translucent carrier element. Thus it is a desire to provide a display panel, an information display comprising the display panel and an appliance that comprises the information display that provide attractive display elements.

Among the advantages of various practices of the embodiments of the present disclosure are that the information display has an attractive front having a relief-like character, which is easy to clean; the display elements (pictograms) can be seen in an unlit state because of the geometric structures on the outer side of the translucent carrier element; a sharply delimited lighted area is achieved by geometric structures realized as identical and congruent depressions; the relief is lighted directly; very different visual appearances may be implemented easily by the combination of protrusions and depressions; the light intensity can be varied by differently dimensioned depressions (for example, different depths), so that lighter and darker areas or contrast intensity curves may be implemented; any arbitrary shape of the display elements can be realized; and display elements can be generated on arbitrarily shaped translucent carrier elements (flat and/or curved).

BRIEF DESCRIPTION OF THE DRAWINGS

While the specification concludes with claims which particularly point out and distinctly claim the subject matter that is regarded as the invention, it is believed the various embodiments will be better understood from the following description taken in conjunction with the accompanying drawings, in which:

DETAILED DESCRIPTION OF THE INVENTION

Figure 1C:
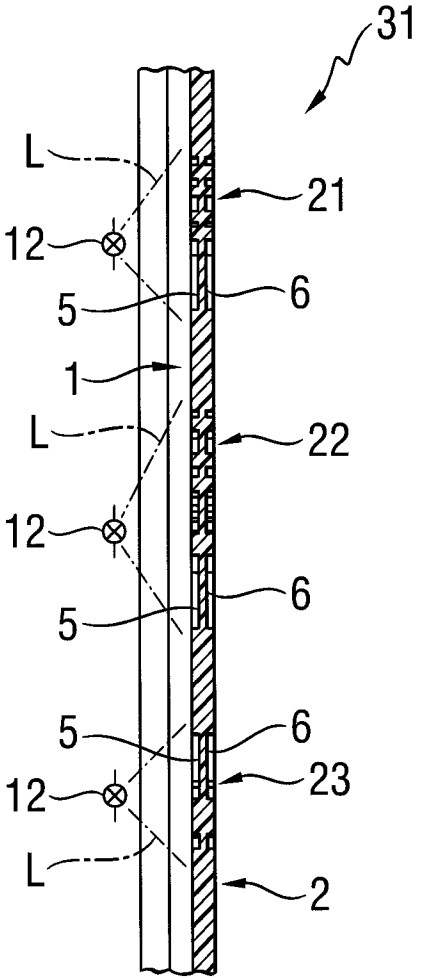
FIG. 1*c* is a magnified view of the display area shown in FIG. 1*b;*

The display panel according to the present disclosure has a translucent carrier element, which is manufactured from an essentially translucent (plastic) material. The display panel has an inner side, an outer side, and a display area. At least one display element is arranged within the display area. The display element is formed by geometric structures that are realized as protrusions and/or depressions on both of the inner side and the outer side of the translucent carrier element, wherein the protrusions and/or depressions are integrally formed with the translucent carrier element, i.e. at least one geometric structure is formed on the outer side and at least another geometric structure is formed on the inner side that together form the display element. In an embodiment, the geometric structures formed on the inner side of the translucent carrier element are only realized as depressions. In one embodiment, the display element can be a pictogram or symbol.

In contrast to a display panel where only a light-opaque masking is applied on the inner side of a translucent carrier element and a blurry image of the masked structure would result on the outer side of the display panel, the display panel described herein having geometric structures on the outer side and the inner side of the translucent carrier element can provide display elements with, for example, a high edge sharpness and other appealing optical effects such as a halo effect.

In an embodiment, the geometric structure(s) that is (are) formed on the inner side and the geometric structure(s) that is (are) formed on the outer side of the translucent carrier element and that together form the display element have essentially identical contour and/or have essentially coinciding positions (i.e. they are congruent). As a result, the geometric structures are symmetrically formed (i.e. they are mirror images) on both sides as protrusions and/or depressions. In particular, the spatial deviation between the geometric structures formed on the inner side and the outer side, respectively, deviates by not more than about 20 micrometers (μm), and in another embodiment, by not more than 10 micrometers, where the spatial deviation is measured with respect to the normal vector of the translucent carrier element, which means that for an identical contour and position of the geometric structure realized on the inner side and the geometric structure realized on the outer side, the normal vector that contacts the contour of one of the geometric structures does so also for the contour of the other geometric structure. A high edge sharpness of the display element contours in a backlit state is achieved when both geometric structures are realized as depressions.

In another embodiment, the geometric structure formed on the inner side is realized as a depression and the geometric structure formed on the outer side is realized as a protrusion, where in particular the contour of the depression envelopes the contour of the protrusion, i.e. the protrusion may be realized within the area of the depression or in other words, the depression has larger spatial extensions than the protrusion.

In yet another embodiment, an essentially light-opaque masking is arranged on the inner side of the translucent carrier element, which light-opaque masking is not covering the geometric structure(s) formed on the inner side. The light-opaque masking may in particular be a layer of black ink, for example, applied via a printing process.

It is to be noted that the geometric structures and the various embodiments described lead to different display elements that in an active state, when the display panel is backlit by light emitting elements, have, for example, high edge sharpness when contour-identical depressions are realized on the inner side and the outer side with coinciding positions or a structure is highlighted by a surrounding diffuse bright area when a large depression is realized on the inner side and a smaller protrusion is realized on the outer side (halo effect). The effects are increased by using an essentially light-opaque masking on the inner side.

In an embodiment, the thickness of the translucent carrier element is from about 0.5 mm to about 3.5 mm and the height extension of the geometric structures in thickness direction (i.e. in the direction of the normal vector) lies in the range of from about 10% to about 50% of the thickness of the translucent carrier element. The thickness value of the translucent carrier element neglects the presence of depressions and protrusions and is measured along the surface normal.

In a further embodiment, the translucent carrier element has a curved shape, i.e. the translucent carrier element is non-planar, in particular non-planar in the display area and it is in particular having a three-dimensionally curved shape.

Multiple display areas may also be implemented on the display panel, which either have depressions on both sides or a depression on one side and a corresponding protrusion on the other side. Different characteristics of the individual display elements may be achieved by a corresponding selection.

In an even further embodiment, the display panel comprises an essentially transparent layer that covers at least a part of the outer side of the translucent carrier element. In particular, the transparent layer may be smooth on its outer side for improved handling properties as any unevenness due to depressions and/or protrusions is avoided. The essentially transparent cover may be slightly colored, e.g. to generate the effect of tinted or smoked glass. The pigments used for coloring the transparent cover essentially only absorb light but do not scatter the light so that the back-lit display elements may only loose some contrast but will not be blurred. The transparent layer can be manufactured from a plastic material. Surface effects, in particular contours may optionally be implemented on the surface of the transparent layer by gloss/matte boundaries.

According to a further aspect of the present disclosure, it is possible to provide the display panel in the area of its outer side with an imprint. For example, the outer side of the translucent carrier element can be printed or the outer side of the transparent layer can be printed. Furthermore, a laser inscription can also be implemented in the area of the display area.

An information display according to the present disclosure comprises a display panel as described and at least one light emitting element such as a LED that is arranged for illuminating the inner side of the translucent carrier element in the area of the display element such that an attractive pictogram or symbol becomes visible on the outer side of the display panel in the backlit state, where the illuminated display element can, for example, have a high edge sharpness or can be a pronounced darker symbol within a diffuse brighter area (halo effect). In an embodiment, several light emitting elements are arranged for selective illumination of several display elements such that, for example, different information can be selectively presented (for example, different operation modes of an appliance such as an electric toothbrush). In particular, the light emitting elements can be separated by light-opaque separation walls for avoiding that neighboring display elements are illuminated. An appliance according to the present disclosure comprises an information display as proposed. An appliance is in particular a handheld electronic appliance such as a mobile phone, a laptop, a PDA, a remote control, a camera, an electronic tool (e.g. drilling machine), a toothbrush, a shaver, a kitchen device etc.

The present disclosure is also concerned with a method of manufacturing a display panel as proposed. The manufacturing method comprises the step of injecting a translucent material, in particular a plastic material having translucent properties, into an injection mold, which injection mold provides a negative image of the geometric structures such that the translucent carrier element is formed.

In an embodiment, a transparent layer is injection molded at least over a part of the translucent carrier element in a second injection molding process step. In another embodiment, an essentially light-opaque masking is applied onto the inner side of the translucent carrier element.

In the different embodiments from FIGS. 1 to 6, the same elements are characterized with the same reference numerals.

Figure 1B:
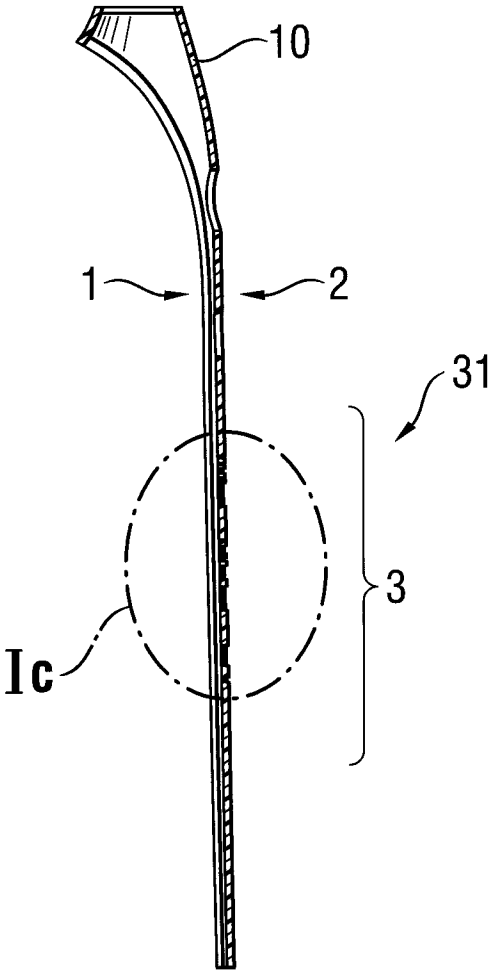
FIG. 1*b* is a side cross-sectional view of the display panel shown in FIG. 1*a;*
Figure 1A:
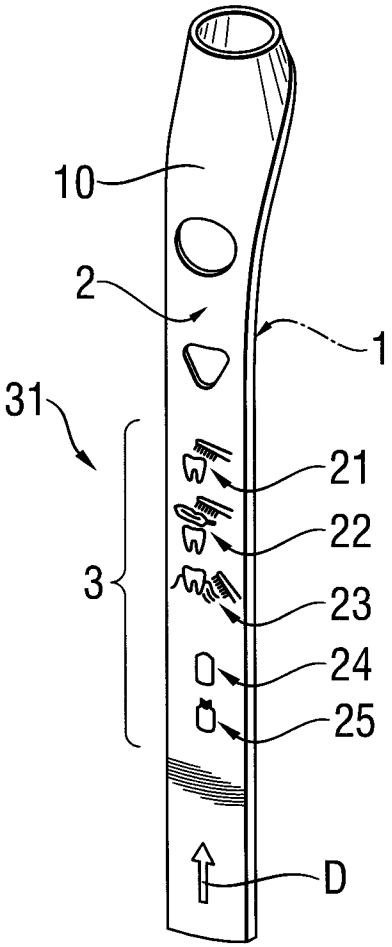
FIG. 1*a* is a perspective view of a display panel according to one embodiment.

FIGS. 1*a*, 1*b*, and 1*c* show an exemplary embodiment of a display panel 31 according to the present disclosure. The display panel 31 comprises a translucent carrier element 10, which can be backlit. The translucent carrier element 10 has an inner side 1 and an outer side 2. The display panel 31 comprises at least one zone functioning as a display area 3. Geometric structures in the form of depressions 5, 6 are formed within the display area 3 both on the inner side 1 and also on the outer side 2 of the translucent carrier element 10 such that display elements 21, 22, 23, 24, 25 are realized. When being backlit (i.e. in a state when the inner side of the translucent carrier element 10 of the display panel 31 is illuminated by light emitting elements 12) a light/dark contrast is achieved by interaction of the geometric structures implemented on both sides of the translucent carrier element 10. The translucent carrier element may in particular also have absorption properties such that the light emitted 12 by a light emitting element is only decently recognizable on the outer side 2 if the material thickness of the translucent carrier element is below a certain value such that only the depressions on the outer side become visible but the translucent carrier element 10 does not emit light at a recognizable strength. The contrast of the backlit display elements 21, 22, 23, 24, 25 with respect to the translucent carrier element 10 can also be enhanced by a masking layer 4 on the inner side, as will be discussed with reference to FIG. 2.

In the shown embodiment, the display panel 31 is realized as a housing part of an electromechanical tooth cleaning device (electrical toothbrush 41—FIG. 2*a*)—where this specific realization should not be intended to limit the scope of the present disclosure to this particular embodiment. The display elements 21-25 (display symbols) are used for visualizing various operating states of the tooth cleaning device. The display elements 21-25 particularly visualize a main cleaning mode 21, a gentle cleaning mode 22, a gum cleaning mode 23, and charge state displays 24, 25. The display symbols 21-25 are implemented by geometric structures like pictograms or icons which are formed on both the inner side 1 and also the outer side 2 on the translucent carrier element 10—for example, by depressions 5, 6 having congruent contours on both sides.

The design of the display panel 31 is further visualized by cross-sectional views shown in FIGS. 1*b* and 1*c*. FIG. 1*c* shows a magnification of the cross-sectional view of the display area 3 of the display panel 31 lying within the elliptical shape shown in FIG. 1*b*. The geometric structures comprise depressions 5, 6 which are molded into the translucent carrier element 10 on both sides and correspond in their contour to the display elements 21-25. In the embodiment shown here, the depressions 5, 6 have identical contours and are congruent with each other. The display effect is thus achieved by depressed display elements 21-25 implemented on both the inner side 1 and the outer side 2. It is also possible to intentionally provide slight contour offsets. In case the translucent carrier element 10 is manufactured by an injection molding process, the mold can be manufactured with a high precision such that any spatial offsets between the depressions 5, 6 on the inner side 1 and the outer side 2 are less than 20 micrometer, in particular less than 10 micrometer.

Figure 2:
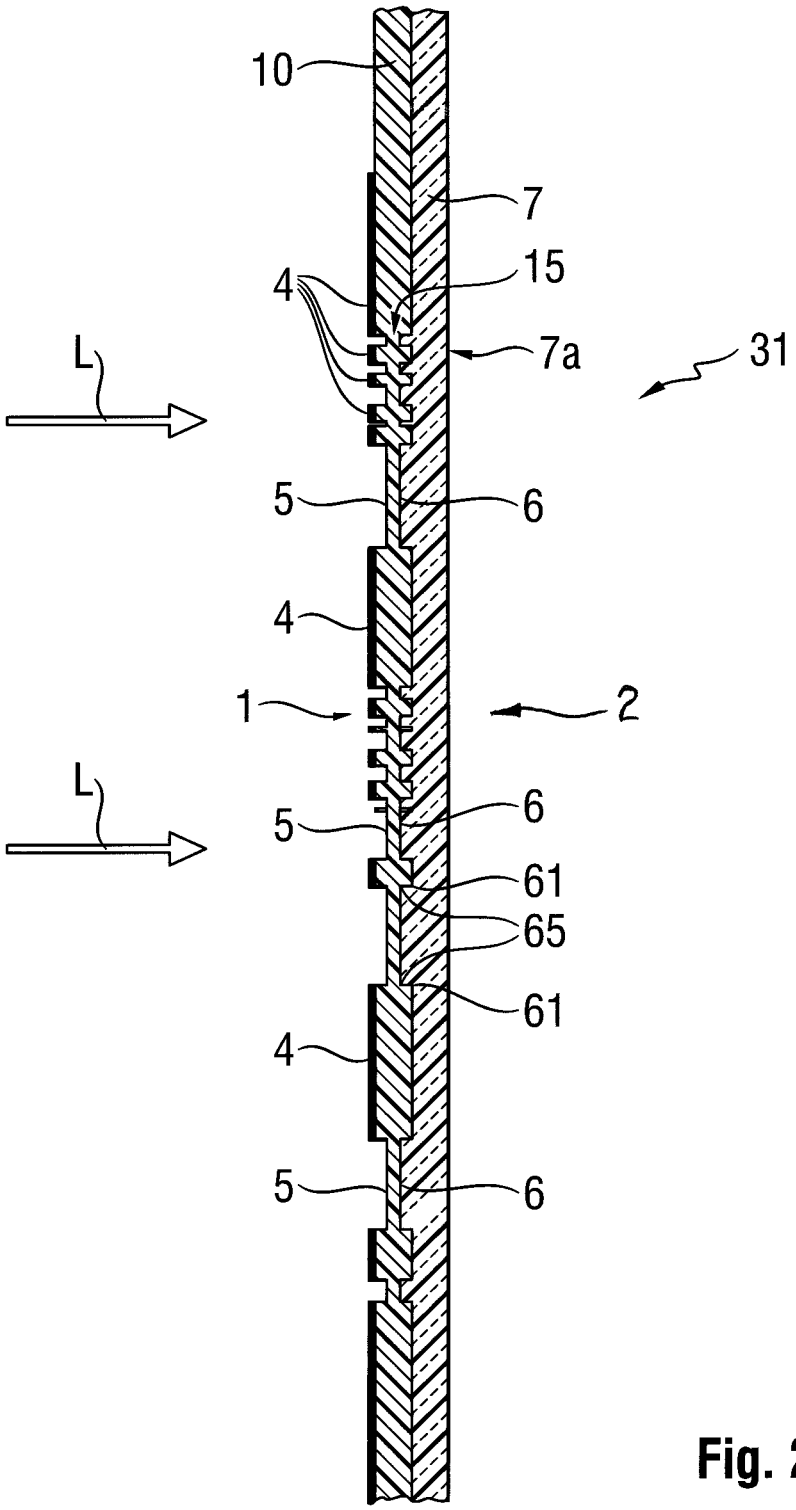
FIG. 2 is a side cross-sectional view of a display panel according to another embodiment.

With respect to FIG. 2, it is also possible to mold an essentially transparent layer 7 over at least a part of the outer side 2 of the translucent carrier element 10. The transparent layer 7 fills up the depressions 6 on the outer side 2 so that a smooth outer surface 7*a* results that improves the handling properties. The smooth face 7*a* is insensitive to dirtying and can be cleaned easily. Geometric structures realized as depressions 5 are formed on the inner side 1 of the translucent carrier element 10.

In the embodiment shown in FIG. 2, a light-opaque masking layer 4 is additionally provided on the inner side 1. As the geometric structures are realized as depressions 5 on inner side 1 of the translucent carrier element 10, the masking layer 4 can be applied by a simple printing process even if the translucent carrier element 10 has a curved shape in the display area 3. The inner side 1 can be printed over its entire area using a Tampoprint® process, for example, without special additional measures, no ink is thereby introduced into the depressions 5 forming the display elements 21-25. The Tampoprint® process is specifically suited for curved surfaces. Without depressions 5 formed on the inner side 1 of the translucent carrier element 10, it would have to be ensured (with great technical effort), that a corresponding opening remains in the masking layer in the area of the display elements 21-25, which is correspondingly identical in contour and congruent with the structure on the part outer side. This is specifically complicated if the translucent carrier element 10 has a curved shape in the display area 3. Further, the congruency of the masking layer cannot be easily achieved with a high precision.

Areas of low material thickness 15 result from the congruent depressions 5, 6 on both sides of the translucent carrier element 10, whereby a higher light output occurs in these areas. In addition, a significantly brighter light output occurs in the area of an outer edge 61 and an inner edge 65 through optical properties, whereby contours of the display elements 21-25 which appear bright are visible.

The essentially transparent layer 7 is provided on the outer side 2 of the translucent carrier element 10. This transparent layer 7 fills up the depressions 6 formed on the outer side 2 of the translucent carrier element 10 and a smooth face 7*a* of the transparent layer 7 can be achieved. Although it is not shown here, it is also possible to implement further display elements such as icon or image contours in the area of the outer side 2, in particular inside the depressions 6, in that bars are realized in the depressions 6, which in turn project forward out of the depressions and may also be printed by a printing method. The bars printed in this way may be dimensioned so that they are then embedded in the transparent cover layer 7 and do not protrude beyond the cover layer outer side 7*a*.

The display area 3 of the display panel 31 is designed in a curved shape D in this example according to FIGS. 1*a* through 1*c*. Alternately, however, a flat shape C according to FIGS. 3*a* through 5 can also be provided, or flat and curved parts could be present in combination. Fundamentally, any arbitrary three-dimensional profile of the display panel 31 can be provided depending on the technical capabilities of a corresponding injection mold.

Figure 2A:
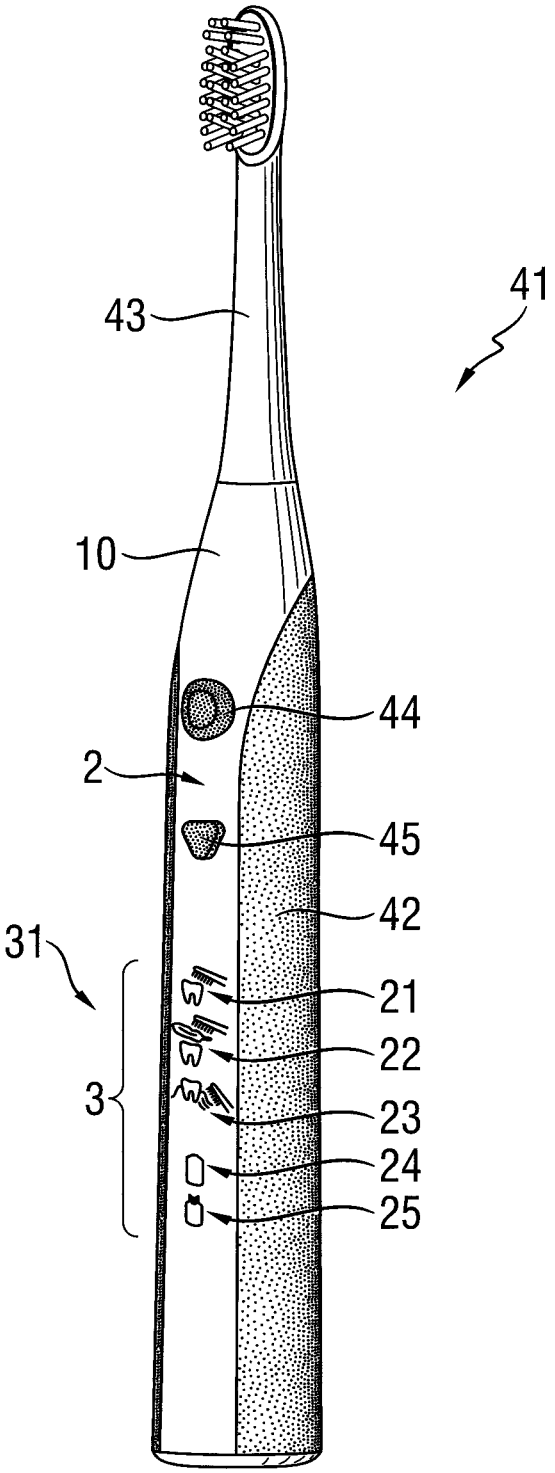
FIG. 2*a* is a perspective view of an electrical toothbrush having the display panel shown in FIG. 1*a;*

FIG. 2*a* shows the display panel 31 as a part of an electric toothbrush 41. The electric toothbrush 41 has a handle part having a brush attachment 43. An operating mode switch 45 is situated adjacent to an operating switch 44. The various types of operation (usage modes) are displayed by the corresponding display elements 21, 22, 23. Still further display elements 24, 25 for indicating a charging state of a battery are arranged adjacent thereto. Depending on the usage mode, at least one display element 21-25 is backlit at a time by selective activation of a light source (LED) 12 (for example, via a respective control unit).

Figure 3C:
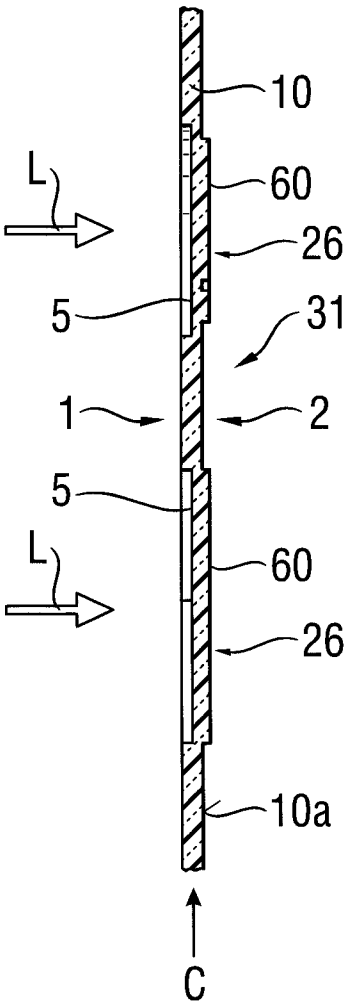
FIG. 3*c* is a magnified view of the display panel shown in FIG. 3*b;*
Figure 3B:
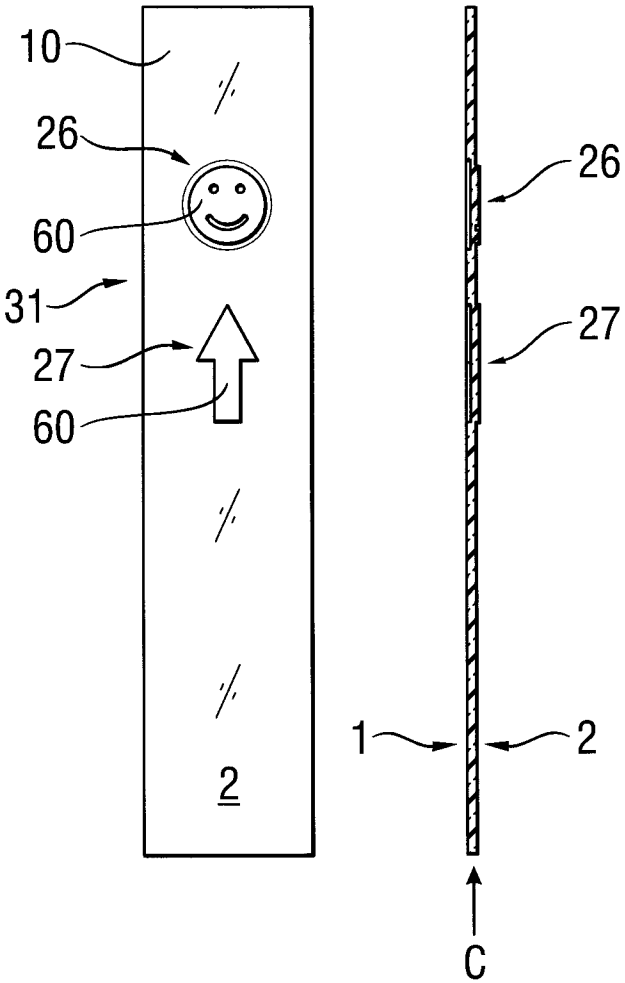
FIG. 3*b* is a front view and side cross-sectional view of the display panel shown in FIG. 3*a;*
Figure 3A:
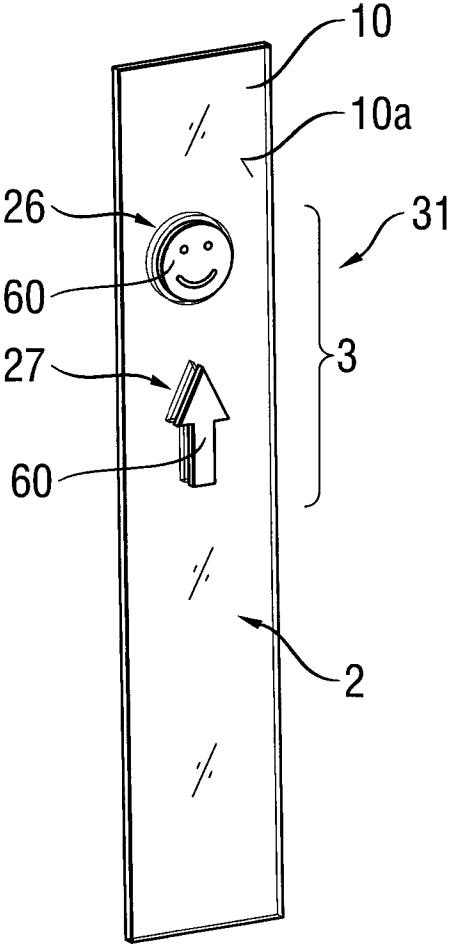
FIG. 3*a* is a perspective view of a display panel according to a third embodiment.

Another embodiment of a display panel 31 is shown in FIGS. 3*a*, 3*b*, and 3*c*, in which the translucent carrier element 10 has protrusions 60 formed on the outer side 2 of the translucent carrier element 10 in addition to depressions 5 (FIG. 3*c*) formed on the inner side 1. In the event of a combination of a depression 5 on the inner side 1 of the translucent carrier element 10 with a protrusion 60 on the outer side 2, interesting optical effects result, which increase the attraction and value of a corresponding appliance that comprises the display panel 31. As can be seen, the upper depression 5 (relating to the smiley-like icon 26) is larger than the upper protrusion 6 (relating to the smiley-like icon 26)—see offset A in FIG. 4*c*. This leads in an active state, when the upper display element 26 is back-lit, to the effect of a somewhat darker protrusion 6 being surrounded by a relatively wide area that appears brighter than the protrusion 6 as the protrusion 6 partially absorbs the light. For the lower icon 27, the protrusion 6 and the depression 5 are congruent (see line B in FIG. 4*c*) such that the effect of a bright area surrounding the somewhat darker protrusion 6 is less pronounced.

Figure 4C:
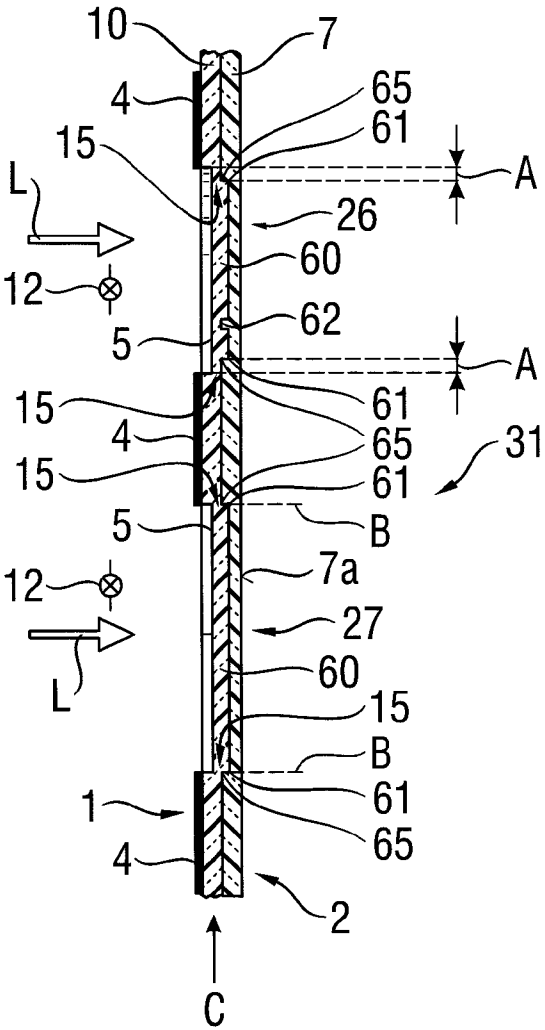
FIG. 4*c* is a magnified view of the display panel shown in FIG. 4*b;*
Figure 4B:
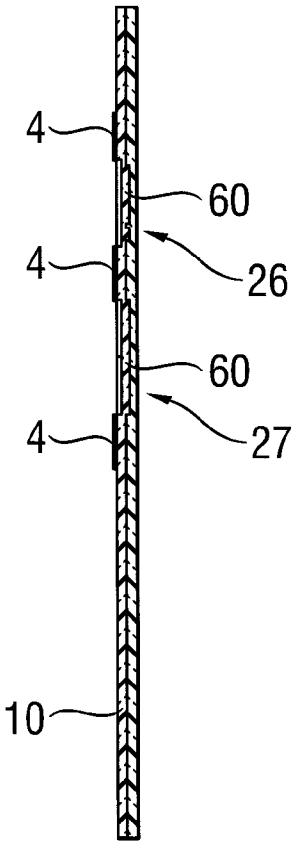
FIG. 4*b* is a side cross-sectional view of the display panel shown in FIG. 4*a;*
Figure 4A:
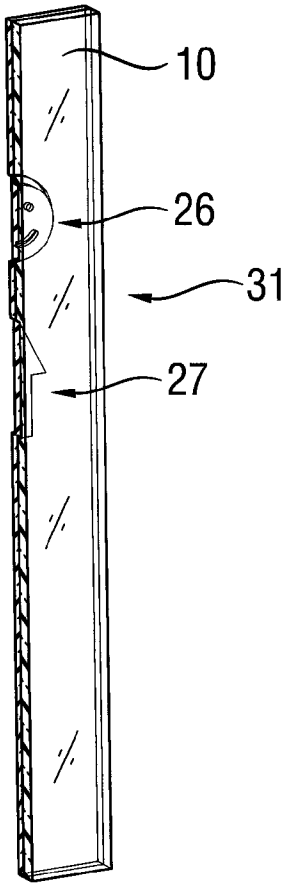
FIG. 4*a* is a perspective view of a display panel according to a fourth embodiment.

As shown in FIGS. 4*a*, 4*b*, and 4*c*, a simple masking layer 4 on the inner side 1 is again possible due to the fact that only depressions 5 are formed on the inner side 1. Depending on the dimensioning of the offset A between the inner depression 5 and the outer protrusion 60, a contour of the display element 26 which is lighted more or less brightly results, which is caused by the corresponding width of the offset A of the areas of low material thickness 15. In contrast, in the display element 27, there is no offset A, but rather congruence of the inner depression 5 and the outer protrusion 60—symbolized by dashed lines B—whereby a more narrowly delimited brightly lit contour results, because the brighter light output only occurs essentially in the area of the outer edge 61 and the inner edge 65. Also scattering effects in the translucent carrier element 10 lead to a small halo effect in case of a congruent depression-protrusion display element 27.

In general, differing light effects may be achieved by the concept according to the invention through a combination of geometric structures realized as depressions and protrusions that form the display elements 21-28. Through a depression 5 on the inner side 1 in combination with a masking layer 4, the lighted area of the display elements 21-28 may be intentionally defined. Via sharp edges 61 and small local depressions 62 in the protrusions filigree shapes of the display elements can be realized.

Figure 5:
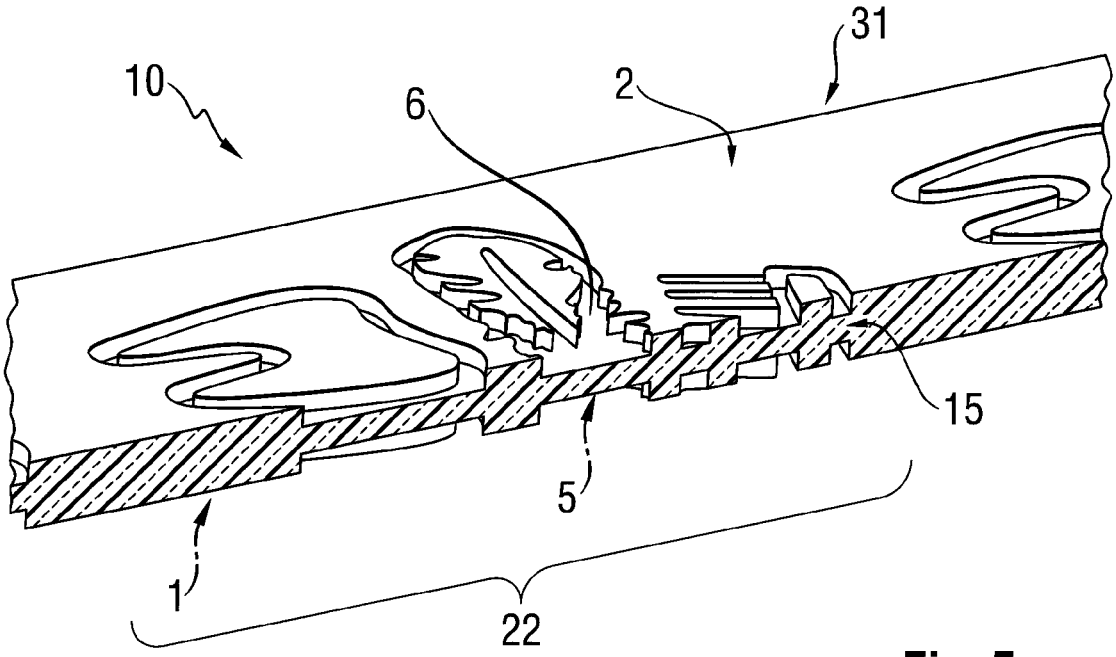
FIG. 5 is a perspective view of a carrier element according to one embodiment.

A further exemplary embodiment of a translucent carrier element 10 is shown in FIG. 5. Geometric structures in the form of depressions 5, 6 are implemented on both the inner side 1 and also on the outer side 2 in a display area 3. The geometric structures are realized as congruent depressions having essentially identical contours. As explained with FIGS. 4*a* through 4*c*, it is possible to apply an additional layer 7, in particular made of an essentially transparent plastic material, in the area of the outer side 2 of the translucent carrier element 10. This additional cover layer 7 fills up the depressions 6 and forms an essentially smooth outer side 7*a*.

Figure 6:
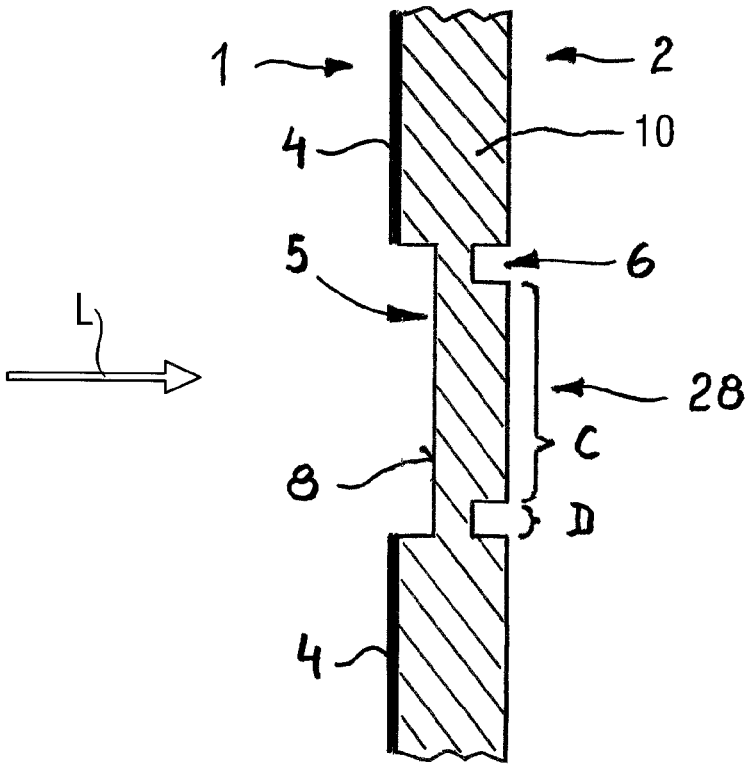
FIG. 6 is a side cross-sectional view of a carrier element according to a second embodiment.

A further exemplary embodiment of a translucent carrier element 10 is shown in FIG. 6 with an exemplary display element 28 in the form of a circle. The carrier element 10 is provided on the inner side 1 with a depression 5 in the form of a full circle. The other outer side 6 is provided with a display element 28 having a depression 6 in the form of an annulus. If light L is back-lit the display element 28 region D of the circle is brighter than the full circle region C, and the full circle region C is brighter than the region outside the display element 28 because the bigger thickness of the translucent carrier element 10. A masking layer 4 is provided at the inner side 5 additionally increases the visible transmissibility contrast at the geometrical structure from the outer side 2.

In a method for manufacturing a display panel, the translucent carrier element 10 having geometric structures forming the display elements 21-28 is produced in an injection-molding method by injecting a (plastic) material having translucent properties into an injection mold. Due to the precise techniques in the manufacturing of the injection mold, a high precision of the molded product can be achieved such that a relative positioning accuracy of the geometric structures on the inner side 1 and the outer side 2 of the translucent carrier element 10 of less than 20 micrometers, in particular about 10 micrometers can result. This high relative positioning precision leads in the case of congruent and identical depressions on the inner side 1 and the outer side 2 to very sharp edges of the display elements 21-28 when being illuminated. Other techniques may not achieve this high precision (for example, a relative positioning deviation of up to 200 μm could result) and a much more blurred impression of the display elements 21-28 would result.

In a further method step of the injection molding method, the essentially transparent layer 7 is injected onto the translucent carrier element 10 using a further injection mold and injecting a material having essentially transparent properties, for example, polycarbonate (PC) or polymethyl methacrylate (PMMA).

The technique according to the present disclosure is suitable for display panels 31 that are used in any type of appliance, in particular in electrical appliances which have display elements, in order to give the user feedback about the operating state or other information. The backlighting of the display area 3 is performed by active light emitting elements, in particular by LEDs 12. The LEDs can be arranged on a circuit board (not shown), for example, and associated accordingly with the display elements 21-28. The information display may be comprised by an electrical appliance, in particular an electric toothbrush, a television, a (mains-operated and/or battery-operated) monitor, a handheld electrical appliance, such as a drill, a mobile telephone, a PDA, a remote control, a digital camera, or the like.

The display panel or the information display may also form a component of an instruction and/or information sign or an electric switch.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "10 μm" is intended to mean "about 10 μm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A display panel for a hand-held electronic appliance, comprising:

a translucent carrier element that has an inner side, an outer side and a display area, wherein the translucent carrier element is configured to comprise a housing part of the hand-held electronic appliance having at least one light-emitting element arranged inside the hand-held electronic appliance; and at least one display element arranged within the display area to be lit during selective activation of the at least one light-emitting element to allow a user to visualize various operating states of the hand-held electronic appliance, the display element being formed by geometric structures realized as protrusions and/or depressions on both of the inner side and the outer side of the translucent carrier element, wherein the protrusions and/or depressions are integrally formed with the translucent carrier element to cause variations in light intensity within the geometric structures, the geometric structures having differential thicknesses such that a portion of a relatively low thickness within the geometric structures causes a relatively higher illumination of the translucent carrier element within the geometric structures, and a portion of relatively high thickness within the geometric structures causes a relatively lower illumination of the translucent carrier element within the geometric structures, wherein at least some of the protrusions and/or depressions on both of the inner side and the outer side of the translucent carrier element are essentially congruent, wherein at least one of said congruent protrusions and/or depressions on one of said inner and outer sides is slightly smaller than the corresponding protrusion and/or depression on the other side, so that when the at least one light-emitting element arranged inside the hand-held electronic appliance is lit, light scattering in said congruent protrusions and/or depressions occur, which leads to a halo effect therein.

2. The display panel according to claim 1, wherein the geometric structures on both the inner side and the outer side of the carrier element have essentially identical contours.

3. The display panel according to claim 2, wherein the positions of the geometric structures on the inner side of the translucent carrier element coincide with at least some of the positions of the geometric structures on the outer side of the translucent carrier element, with a maximum spatial deviation of about 10 μm, so that the geometrical structures are symmetrically formed on said inner and outer sides as protrusions or depressions, and wherein the geometric structures on the inner side mirror the geometric structures on the outer side.

4. The display panel according to claim 1, wherein the geometric structures that are arranged on the inner side and the outer side are all realized as depressions.

5. The display panel according to claim 1, wherein the depressions on the inner side of the translucent carrier element are provided with a plane having the same area as the whole display element of the outer side of the translucent carrier element.

6. The display panel according to claim 1, wherein the geometric structure arranged on the inner side is realized as a depression and the geometric structure arranged on the outer side is realized as a protrusion that in particular has a smaller spatial extension than the depression.

7. The display panel according to claim 1, wherein the translucent carrier element is at least partially covered with an essentially transparent layer on the outer side.

8. The display panel according to claim 7, wherein the outer side of the covered transparent layer is flat.

9. The display panel according to claim 7, wherein the outer side of the covered transparent layer is curved.

10. The display panel according to claim 1, wherein the translucent carrier element has a curved shape at least in the display area.

11. The display panel according to claim 1, wherein the translucent carrier element has a thickness in the range from about 0.5 mm to about 3.5 mm at least in the display area, and the geometric structures have an extension in the thickness direction that lies in the range of from about 10% to about 50% of the thickness of the translucent carrier element.

12. The display panel according to claim 1, wherein an essentially light-opaque masking layer is arranged on the inner side of the translucent carrier element.

13. An information display that comprises a display panel according to claim 1, wherein the display panel comprises several display elements and several light-emitting elements that are arranged such that each of the light-emitting elements is assigned to only one of the display elements for selective activation thereof.

14. An electrical toothbrush comprising an information display according to claim 13, wherein the information display is structured and configured to display information selected from the group consisting of a cleaning mode of the electrical toothbrush and a charge state of the electrical toothbrush.

15. The display panel according to claim 13, wherein the several light-emitting elements arranged inside the hand-held electronic appliance are separated from one another by light-opaque separation walls for avoiding illumination of neighboring display elements.

16. A method of manufacturing the display panel according to claim 1, comprising the step of injecting a translucent material into a mold, the mold providing a negative image of the geometric structures.

17. The method according to claim 16, wherein an essentially transparent layer is injection molded as a further injection step onto the at least a part of the outer side of the translucent carrier element.

18. The method according to claim 16, wherein an essentially light-opaque masking layer is applied onto the inner side of the translucent carrier element but not onto the geometric structures arranged on the inner side.

19. The display panel according to claim 1, wherein the hand-held electronic appliance is selected from the group consisting of a mobile phone, a laptop, a PDA, a remote control, a camera, an electronic tool, a toothbrush, a shaver, and a kitchen device.

* * * * *